US006168418B1

(12) United States Patent
Levinson

(10) Patent No.: US 6,168,418 B1
(45) Date of Patent: Jan. 2, 2001

(54) IGNITION SYSTEM WITH DELAY SWITCH FOR A GAS APPLIANCE

(75) Inventor: Lionel Monty Levinson, Niskayuna, NY (US)

(73) Assignee: General Electric Company, Schenectady, NY (US)

( * ) Notice: Under 35 U.S.C. 154(b), the term of this patent shall be extended for 0 days.

(21) Appl. No.: 09/301,981

(22) Filed: Apr. 29, 1999

(51) Int. Cl.[7] ..... F23N 5/20; F23N 5/22

(52) U.S. Cl. ..... 431/6; 431/67; 431/73; 431/256; 137/514; 200/34; 251/48

(58) Field of Search ..... 431/6, 18, 67, 431/72, 73, 86, 254, 255, 256, 257, 28; 200/34; 251/48, 15, 20, 23; 137/514, 514.5, 514.7

(56) References Cited

U.S. PATENT DOCUMENTS

| | | | | |
|---|---|---|---|---|
| 1,673,063 | * | 6/1928 | Denison | 431/67 |
| 2,981,323 | * | 4/1961 | Marks | 431/67 |
| 3,334,204 | * | 8/1967 | Brenny et al. | 200/34 |
| 3,523,201 | * | 8/1970 | Good | 431/256 |
| 3,649,154 | * | 3/1972 | Palmer et al. | 431/6 |
| 3,681,721 | * | 8/1972 | Wessel et al. | 200/34 |
| 3,963,410 | | 6/1976 | Baysinger . | |
| 4,529,373 | * | 7/1985 | Ortlinghaus | 431/6 |
| 4,614,491 | * | 9/1986 | Welden | 431/86 |
| 4,711,628 | | 12/1987 | Geary . | |
| 5,514,630 | | 5/1996 | Willkens et al. . | |
| 5,722,823 | | 3/1998 | Hodgkiss . | |
| 5,791,890 | | 8/1998 | Maughan . | |
| 5,820,789 | | 10/1998 | Willkens et al. . | |

OTHER PUBLICATIONS

Ceramic Heaters, Kyocera Corp. Catalog No. CAT/1T9606TYA3580E (1995).

* cited by examiner

*Primary Examiner*—Ira S. Lazarus
*Assistant Examiner*—Josiah C. Cocks
(74) *Attorney, Agent, or Firm*—Noreen C. Johnson; Douglas E. Stoner

(57) ABSTRACT

An ignition system for a gas appliance comprises an ignitor for igniting gas, a gas valve which controls the flow of gas to the ignitor, and a delay switch which delays the opening of the gas valve. The delay switch comprises a piston and a cylinder which define a chamber. The piston moves between a first position and a second position in the cylinder. The piston is coupled to the gas valve such that when the piston reaches the second position, the gas valve is opened. The chamber includes a large aperture and a small aperture which influence the rate at which the piston moves. The large aperture includes a sealing member which seals the large aperture when the piston moves from the first position to the second position to resist the motion of the piston. The large aperture is opened when the piston moves in the other direction. The delay switch is connected to the ignitor such that when the ignitor is turned on, the piston moves against air resistance and delays the opening of the gas valve. When the ignitor is turned off, the piston moves quickly in the other direction to deactivate the gas valve.

44 Claims, 8 Drawing Sheets

IGNITION SYSTEM WITH DELAY SWITCH FOR A GAS APPLIANCE

FIELD OF THE INVENTION

The present invention is related to gas ignition systems. In particular, the present invention is related to gas ignition systems for gas appliances and heating equipment, including gas ranges.

BACKGROUND

Conventional gas appliances and heating equipment, such as gas ranges, often use silicon carbide (SiC) hot surface ignitors. The SiC ignitor is normally placed in series with the gas valve. The gas valve is designed to open when the current supplied to it exceeds a certain value. The SiC ignitor has a carefully controlled resistance versus temperature characteristic such that: (1) when current is initially supplied to the ignitor and the ignitor is cold, it has a relatively high resistance that keeps the current low enough so the gas valve stays closed; and (2) when the ignitor heats up, the resistance drops so the current becomes sufficiently large to open the gas valve. When the current reaches this threshold point, the ignitor is hot enough to ignite the gas. This resistance versus temperature relationship serves as a "fail-safe" in that the ignitor must reach a certain temperature before the gas valve opens, thus avoiding the situation of gas flowing to an ignitor which is not hot enough to ignite the gas.

Conventional SiC gas range ignitors are produced by several commercial vendors, including Surface Igniter Co. of Chagrin Falls, Ohio and Saint-Gobain/Norton Co. of Milford, N.H. Some of the problems with these conventional ignitors are that they are porous, fragile, and expensive. In addition, the resistance versus temperature characteristics of these conventional SiC ignitors may alter or drift over time, thereby adversely affecting their reliability.

Ignitor materials which are more mechanically robust than SiC have also been developed. One such ignitor, the Mini-ignitor®, available from the Saint-Gobain/Norton Company of Milford, N.H., comprises a pressure sintered composite of aluminum nitride ("AIN"), molybdenum disilicide ("$MoSi_2$"), and silicon carbide ("SiC"), and is designed for 8 volt through 48 volt applications. However, the resistance versus temperature characteristics of the pressure sintered composite material is different from the resistance characteristics of conventional ignitor materials such as SiC. Generally, the pressure sintered composite material has a resistance which increases with temperature (e.g., a metallic resistance characteristic). Accordingly, pressure sintered composite ignitors are not compatible with existing conventional ignition systems, which rely on a resistance fail safe region.

Thus, there is a need for an ignition system which is robust, which does not rely on a resistance fail safe region, and which is not susceptible to performance degradation due to temperature drifts.

SUMMARY

A delay switch for a gas appliance, according to an exemplary embodiment of the invention, comprises a first member, a second member which moves relative to the first member, an activator which moves the second member relative to the first member from a first relative position to a second relative position in a first time period, and a deactivator which moves the second member relative to the first member from the second relative position to the first position in a second time period less than the first time period, wherein the second member is coupled to the gas valve such that when the first and second members are in the second relative position, the gas valve is open, and when the first and second members are in the first relative position, the gas valve is closed.

Another embodiment of the invention relates to a method of controlling the opening of a gas valve comprising the steps of: (a) electrically coupling an ignitor to a delay switch, such that the delay switch is activated in response to the ignitor receiving a predetermined current level, wherein activation of the delay switch includes: driving a first member of the delay switch from a first position to a second position relative to a second member of the delay switch, and providing a resistive force which resists movement of the first member from the first position to the second position; and (b) coupling the first member of the delay switch to the gas valve such that when the first member reaches the second position, the gas valve is opened.

The delay switch is typically used in conjunction with an ignitor, a power source, a gas burner, and a gas valve. The first and second members of the delay switch may take the form of a cylinder and a piston which reciprocates within the cylinder. The chamber defined by the piston and cylinder includes a large aperture and a small aperture which influence the rate at which the piston moves.

DETAILED DESCRIPTION OF THE PREFERRED EMBODIMENTS

Figure 1:
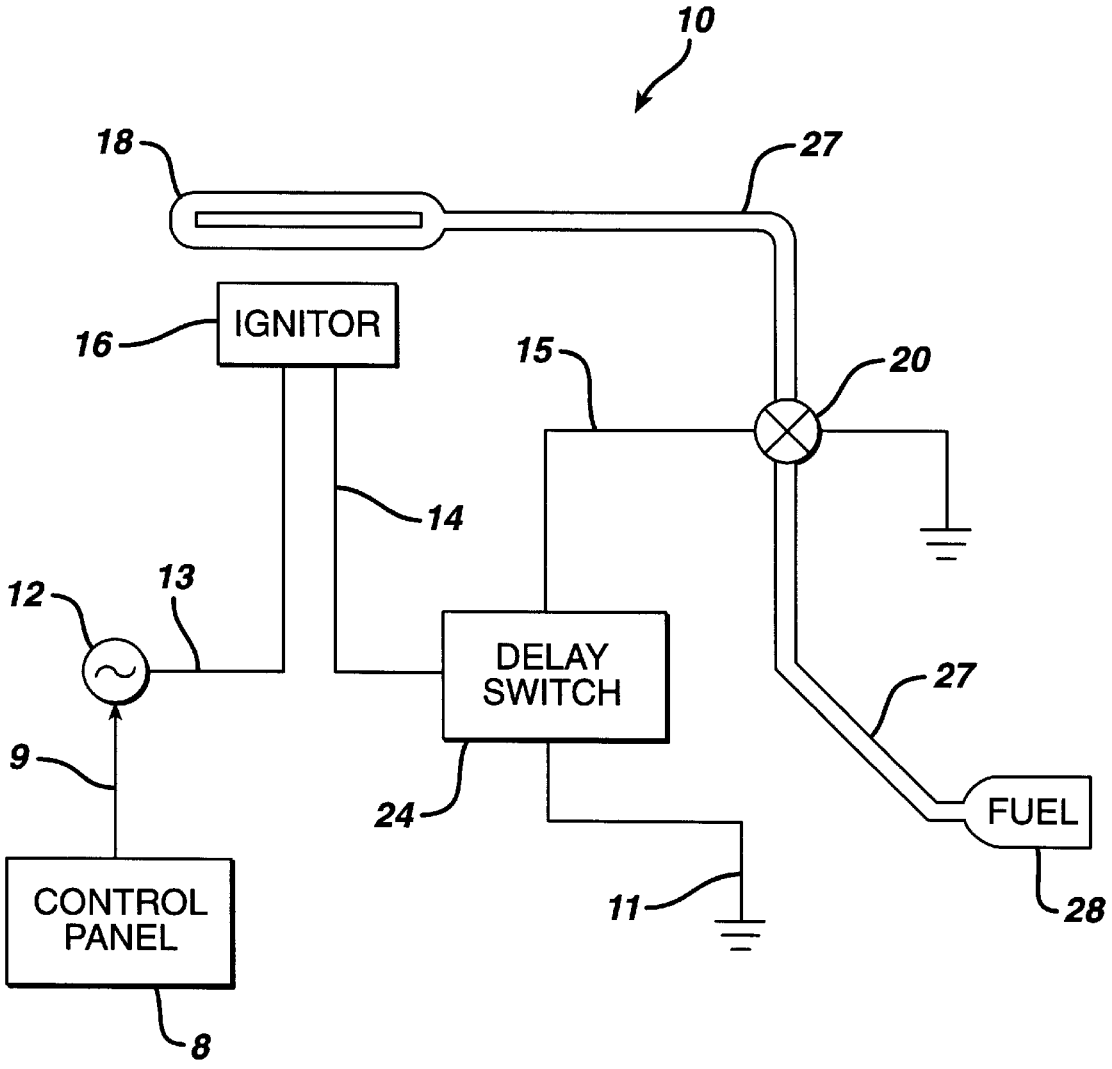
FIG. 1 is a drawing of an ignition system for a gas appliance according to one embodiment of the invention.

An ignition system according to an exemplary embodiment of the invention is shown in FIG. 1. The ignition system 10 includes a power source 12, an ignitor 16, a burner 18, a gas valve 20, a delay switch 24, and a gas supply tank 28. The power source 12 provides power to the ignitor 16. The power source 12 can be a standard 120 volt alternating current (AC) power source, for example. Alternatively, the power source 12 can be an 80 volt power source or a 240 volt power source. Line 13 couples the ignitor 16 to the power source 12. Lines 13, 14 and 15 couple the gas valve 20 to the power source 12 through the delay switch 24 and the ignitor 16.

The ignitor 16 can comprise a pressure-sintered composite material or other material which has a metallic resistance characteristic, for example, as will be discussed below. The burner 18 is adapted to be supplied fuel, such as natural gas, propane, etc., from the fuel tank 28 via a gas conduit 27. The ignitor 16 is positioned adjacent to the burner 18, which can be housed inside an oven chamber, for example. Alternatively, the burner 18 can be located atop a conventional range. A conventional gas regulator (not shown) can be disposed, if desired, in the conduit 27 between the fuel source 18 and the valve 20. When the valve 20 is open, fuel flows to the burner 18. Generally, the ignitor 16 remains energized whenever the gas valve 20 is open. The valve 20 can be any type of suitable valve such as a conventional solenoid valve.

The power source 12 provides energy to activate the ignitor 16, the delay switch 24, and the gas valve 20. The power source 12 can be configured to receive a control signal via line 9 from a user-operated control panel 8, which can cause the ignition of gas at the burner 18 and set a desired temperature, for example. When the user-operated control panel is in an "off" position, current is not available to the ignitor 16 or the gas valve 20 from the power source 12.

Figure 2:
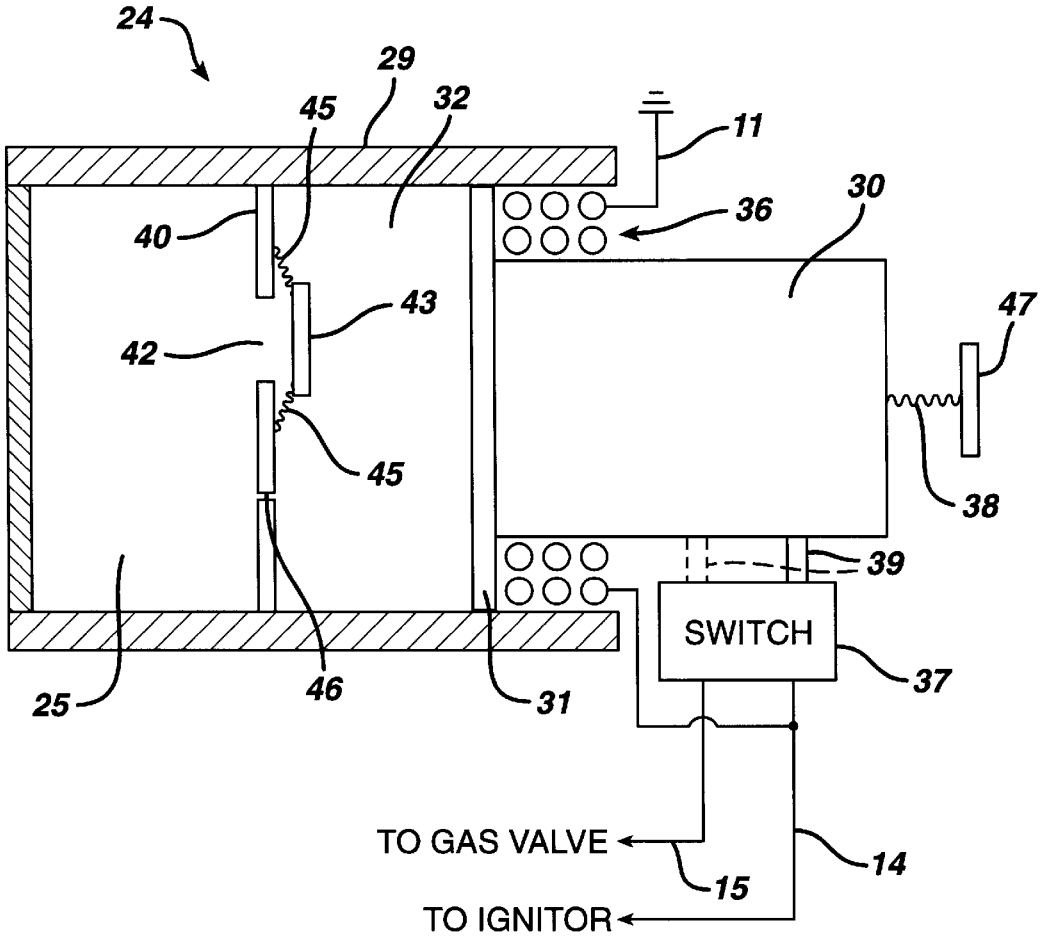
FIG. 2 is drawing of the delay switch in FIG. 1 which is electrically coupled to the gas valve.

The delay switch 24 is shown in more detail in FIG. 2, according to an exemplary embodiment of the invention. The delay switch includes a cylinder 29 (or other "first member"), and a piston 30 (or other "second member"), which reciprocates within the cylinder 29 between a first position and a second position. As will be discussed below, in the first position (shown in FIG. 2 by the coupling member 39 in solid lines), the gas valve is deactivated, while in the second position (shown by the coupling member 39 in dashed lines), the gas valve is activated.

A plunger 31 or other sealing member may extend radially outwardly from the piston 30 to form a tight seal with the inner surface of the cylinder 29. The cylinder 29, the plunger 31, and a wall 40 define a chamber 32. The piston is moved from the first position to the second position by an activator such as a coil 36 disposed around the piston. The coil 36 receives a current, e.g. via line 14 from the ignitor, to generate a magnetic field which interacts with a second magnetic field. The second magnetic field may be generated by, for example, a permanent magnet (not shown), to move the piston 30 further into the cylinder 29. The second magnetic field may also be induced by the coil-generated magnetic field.

The piston 30 is moved from the second position to the first position, in a direction out of the cylinder 29, with a deactivator such as a spring 38. The spring 38 can be fixed to a supporting structure 47 of the delay switch 24, for example. The spring 38 is typically configured such that it is stretched when the coil 36 is activated and it pulls the piston 30 in a direction out of the cylinder 29 when the coil 36 is deactivated.

An electrical switch 37 is coupled to the piston 30 through a coupling member 39 which is fixed to the piston 30. In FIG. 2, the coupling member 39 is depicted in solid lines in the first position and dashed lines in the second position. When the piston 30 is in the first position, no power is applied to the gas valve 20. When the piston 30 is in the second position, the switch 37 connects the ignitor (line 14) to the gas valve (line 15). The coupling member 39, which is attached to the piston 30, activates the switch 37 as the piston moves. As is well known in the art, the switch 37 is preferably designed to rapidly connect the ignitor to the gas valve when the piston reaches the second position, and to rapidly disconnect the ignitor from the gas valve when the pitson reaches the first position. Suitable switches are available from Carlingswitch Inc., of Plainville, Conn., and Cherry Electrical Products, of Waukegan, Ill., for example.

As shown in the embodiment of FIG. 2, the chamber 32 is partially defined by a wall 40 having a large aperture 42 and a small aperture 46. The large aperture 42 includes a sealing member 43 which seals the large aperture 42 at selected times. The sealing member 43 may be coupled to the wall 40 through at least one spring 45, for example. The mechanical resistance value of the spring 45 is typically selected such that when the piston 30 is activated by the coil 36 to move further into the cylinder 29, the air pressure inside the chamber 32 acts to overcome the resistance of the spring 45 and cause the sealing member 43 to seal the large aperture 42. Consequently, air in the chamber 32 is forced through the small aperture 46, which acts to resist the movement of the piston. Although the large and small apertures are depicted in FIG. 2 as single holes, each can alternatively comprise multiple holes.

The dimensions of the chamber 32 and the small aperture 46, and the force produced by the coil 36 are selected to provide a desired rate at which the piston 30 travels into the cylinder 29 when activated by the coil 36. The desired rate produces a desired delay time as the piston travels from the first position to the second position. The delay time can be set as desired, and is typically about 5–30 seconds, more typically at least 10 or 15 seconds, e.g. 10–25 seconds. The delay time is provided to delay opening of the gas valve 20 until the ignitor 16 has reached a temperature high enough to ignite the gas flowing through the burner 18.

The dimensions of the large aperture 42 and the stiffness of the spring 38 are typically chosen to allow the piston 30 to retract quickly when the coil 36 is deactivated. For example, the large aperture 42 and the spring 38 can be designed to allow the piston to move from the second position to the first position in less than 1 second.

Also shown in FIG. 2 is a second chamber 25 on the other side of the wall 40 from the first chamber 32. The second chamber 25 can be provided to reduce or eliminate the possibility of dirt or debris entering the first chamber 32 through the large and small apertures 42, 46. The second chamber 25 typically has a volume which is relatively large (e.g. 5 times as large) compared to the volume of the first chamber 32 so that the second chamber 25 does not experience a substantial pressure change as the piston 30 moves.

As will be recognized by those skilled in the art, various modifications can be made to the embodiment shown in FIG. 2. For example, one or both of the large and small aperture 42, 46 can be installed on the plunger 31 rather than on the wall 40. Various activating devices such as springs, magnetic coils, bimetallic strips, hydraulic actuators, and fluidic actuators can be used to move the piston 30 in the cylinder 29. The delay switch can be designed such that the delay period which precedes connection of the ignitor to the gas valve takes place while the piston 30 moves out of, rather than into, the cylinder 29. Other dampers besides air resistance through a small aperture can be used to resist the movement of the piston 30. For example, nitrogen or an inert gas can be used for resistance. Liquids such as silicone oil can also be used. In general, the delay switch may comprise a first member (e.g. the cylinder 29) which moves relative to a second member (e.g. the piston 30) in one direction faster than in another direction. In this way, a delay is provided as the first member moves to activate the gas valve, whereas the deactivation takes place rapidly.

Figure 3:
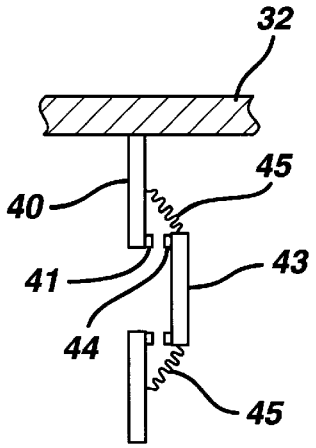
FIG. 3 is a drawing of an embodiment of the sealing member in FIG. 2 which includes magnets.

According to another embodiment shown in FIG. 3, the sealing member 43 can be closed by a magnetic force between a first magnet 44 on the sealing member 43 and a second magnet 41 on the wall 40. For example one of the magnets may be an electromagnet activated by a current, while the other magnet is a permanent magnet. The electromagnet is activated to seal the large aperture 42 when the piston coil 36 is activated to force the piston 30 into the cylinder 29. In this embodiment, the force of the spring 45 acts to open the aperture 42 when the electromagnet is not active.

Figure 4:
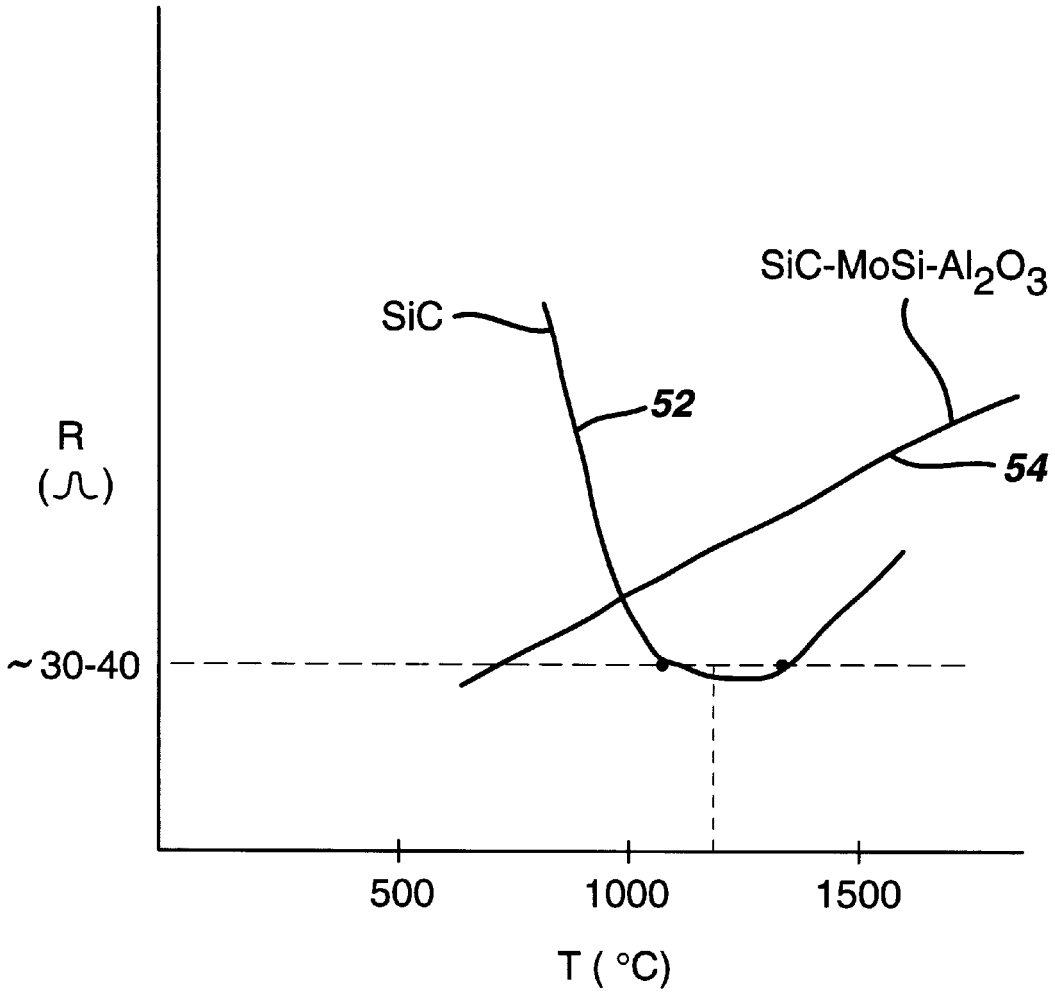
FIG. 4 is a graph of the resistance characteristics of two ignitor materials as a function of temperature.

According to one embodiment of the present invention that produces acceptable results, the ignitor 16 comprises a material which has a metallic resistance characteristic in which resistance increases with temperature. As mentioned above, conventional ignitors, such as silicon carbide (SiC) ignitors, are implemented in conventional ignition systems based on their resistance characteristics. As the temperature of the SiC ignitor increases, its resistance decreases. An example of this relationship is depicted in FIG. 4, wherein the Y axis represents resistance, and the X axis represents temperature. Resistance curve 52 represents a conventional SiC ignitor used in gas appliances. The resistance curve 52 for the SiC ignitor drops to a resistance of about 30 to 40 ohms (Ω) at temperatures approaching 1200 degrees centigrade. As the temperature continues to increase, the resistance rises to a level greater than 40Ω, and continues upward. This region of the resistance curve has been utilized in some conventional ignition systems as a safety feature, or fail-safe region, in that a gas valve is only actuated when the resistance falls within a certain range.

The ignition system according to exemplary embodiments of the invention includes an ignitor made from a material having a resistance versus temperature characteristic that typically does not exhibit a fail safe region such as that shown in curve 52. Conventional ignition systems relying on a resistance fail-safe region are thus generally incompatible with ignitors having a metallic resistance characteristic.

According to one embodiment of the invention, the ignitor 16 comprises a composite material which may be formed by pressure sintering. Typically, the composite material includes an insulating ceramic, a semiconductive ceramic, and a metallic conductor. The insulating ceramic may comprise, for example, the nitride of a metal, e.g. AlN or $Si_3N_4$, or the oxide of a metal, e.g. $Al_2O_3$. Examples of suitable semiconductive ceramics include silicon carbide and boron carbide. Suitable metallic conductors include molybdenum disilicide and iron alloys, for example. The composite material typically has a metallic resistance characteristic. Examples of suitable pressure sintered composite materials include SiC—$MoSi_2$—AlN and SiC—$MoSi_2$—$Al_2O_3$ composites, which are commercially available. Typically, the ignitor operates at a temperature of about 800–1500° C., more typically 1200–1400° C.

According to exemplary embodiments of the invention, SiC—$MoSi_2$—AlN or SiC—$MoSi_2$—$Al_2O_3$ is utilized as the composite ignitor material. As shown in FIG. 4, SiC—$MoSi_2$—$Al_2O_3$ has a metallic resistance versus temperature characteristic in which the resistance of the material continues to increase with temperature, as shown by curve 54. Other suitable ignitor compositions may exhibit a metallic resistance versus temperature characteristic which may have a greater or lesser slope than that of curve 54.

The composite ignitor can be made according to pressure sintering techniques that are well known to those skilled in the art. For example, the starting materials can be mixed in powder form to form large blocks of the composite ignitor material. The block is then sintered and hot-pressed. The block is cut into a conventional ignitor shape. Electrical leads and conductors are metalized onto the ends of the ignitor. Such composite ignitors are commercially available from Norton Ignitor Products of Milford, N.H., for example.

Figure 5:
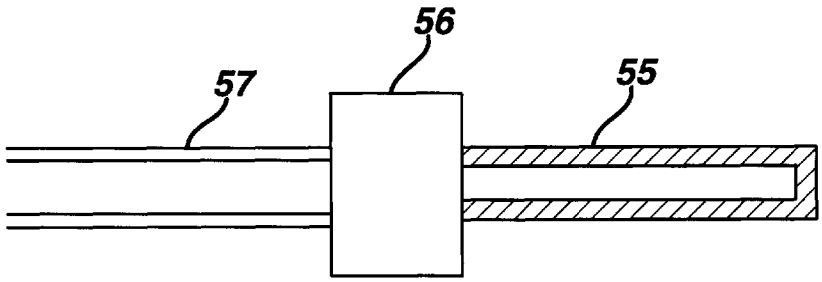
FIGS. 5–6 are drawings of ignitors made from a composite material.
Figure 6:
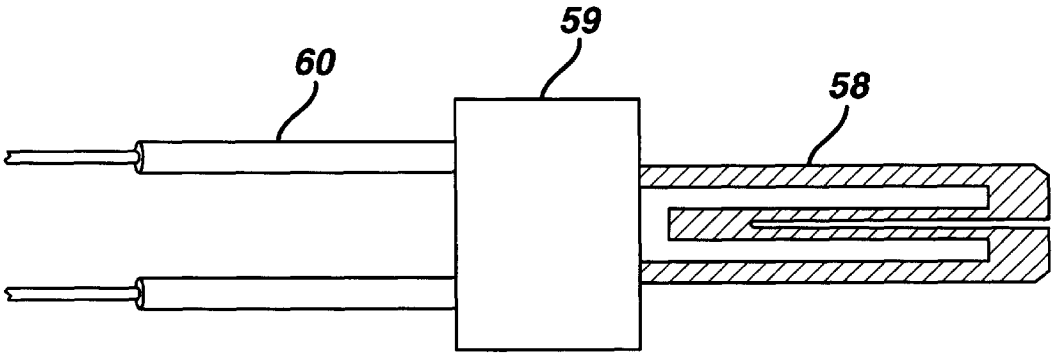

The composite material can be utilized in conventional ignitor designs such as shown in FIGS. 5 and 6. In FIG. 5, the composite material is constructed into a hair-pin or "U"-shaped ignitor 55. A ceramic (or the like) holder 56 is filled with a high temperature insulating material and holds ignitor 55 in place in the gas stream. Leads 57 provide current to ignitor 55 in order to heat ignitor 55 to a desired temperature. FIG. 6 shows an alternative shape ignitor 58 that is held by a ceramic (or the like) holder 59 and is heated via leads 60. In addition, a metal shield assembly (not shown) and/or other conventional ignitor accessories can be utilized as would be apparent to one of skill in the art given the present description.

Figure 7:
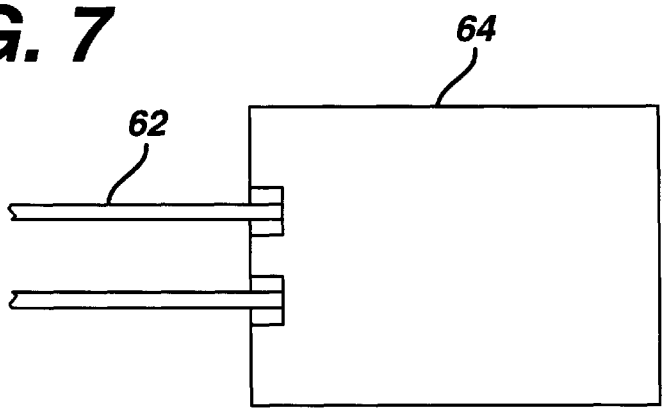
FIG. 7 is a drawing of another embodiment of an ignitor made from a resistive material disposed between two ceramic members.

The ignitor, according to another embodiment of the invention, may comprise a resistive material disposed between two ceramic members. FIG. 7 shows an example of a suitable ignitor of this type. In FIG. 7, the leads 62 are electrically connected to the resistive material disposed between two ceramic plates 64. The resistive material receives the current and generates heat, and may comprise, for example, molybdenum, tungsten, or a compound of tungsten such as tungsten carbide or tungsten silicide. The ceramic material, which may comprise silicon nitride for example, provides high temperature strength and thermal shock resistance to make the structure robust and isolates the resistive material from the ambient gases in the oven, for example. The resistance characteristic of this type of heater is typically a metallic resistance characteristic in which resistance increases roughly linearly with temperature. Such heaters are commercially available from Kyocera Corporation, for example.

Referring again to FIGS. 1 and 2, in operation, when the user turns on the ignition system, current is supplied to the ignitor 16 and the delay switch 24. While the ignitor heats up, the coil 36 of the delay switch 24 is activated to force the piston 30 into the cylinder 29. The air resistance provided by the small aperture 46 acts to resist movement of the piston 30 such that a preselected time period, e.g. 20 seconds, elapses before the piston reaches the second position, activating the gas valve. By this time, the ignitor has been heated to a temperature which is sufficient to ignite the gas.

When power is disconnected from the ignitor 16, either under the user's control or due to a power failure, the power is also disconnected from the coil 36. The spring 38 then acts to pull the piston in a direction out of the cylinder 29 to the first position, deactivating the gas valve 20. The movement of the piston 30 from the second position to the first position typically takes place relatively quickly, because the large aperture 42 opens, which significantly reduces any air resistance to the movement. In the event that power is reconnected to the ignitor 16, the gas valve is activated only after the preselected delay period, since the piston must again travel against air resistance from the first position to the second position.

Figure 8:
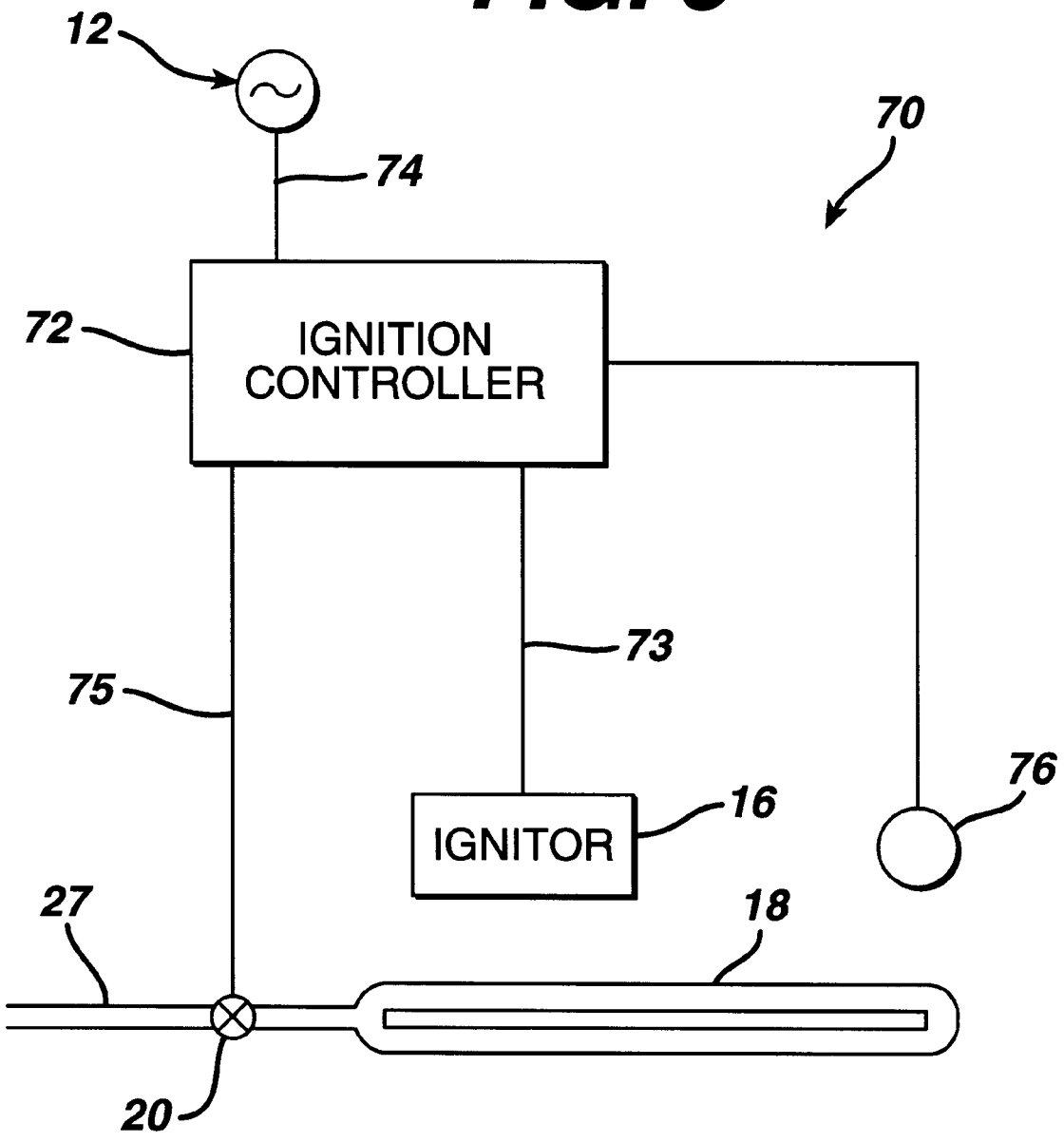
FIG. 8 is a diagram of an ignition system according to another embodiment of the invention.

An ignition system according to another embodiment of the invention is shown in FIG. 8. The ignition system 70 includes an ignition controller 72, an ignitor 16, a burner 18, and a current actuated gas valve 20. The ignition controller 72 is coupled to a power source 12 via line a 74. The ignitor 16 is coupled to the ignition controller 72 via line 73. The ignitor 16 may comprise a material which has a metallic resistance characteristic, as discussed above. The ignition controller 72 is also coupled to the gas valve 20 via a line 75. The burner 18 receives fuel, such as natural gas, propane, etc., from a fuel source (not shown) via a gas conduit 27. A conventional gas regulator (not shown) can be disposed in conduit 27 between the fuel source and valve 20. The valve 20 can be any type of suitable valve such as a conventional solenoid valve, for example.

Optionally, an ignition indicator 76 can also be provided proximate to the burner 18. The ignition indicator 76 can be a thermostat, a thermocouple, a resistance temperature device, a light sensor, or other flame sensitive device, for example. The ignition indicator 76 can be used to determine when flames are present.

The ignition controller 72 is able to control the opening and closing of the gas valve 20 as well as the energization of the ignitor 16. The ignition controller 72 can be adapted to control the ignition of additional burners and the opening of additional valves as would be apparent to one of skill in the art given the present description. The ignition controller 72 can be adapted to receive a selection or control signal from a user-operated control knob (not shown), which can cause the ignition of gas at burner 18 and set a desired temperature within an oven chamber, for example. When the user-operated control knob is in an "off" position, current is not available to the ignitor 16 or gas valve 20 from the power source 12.

Figure 9:
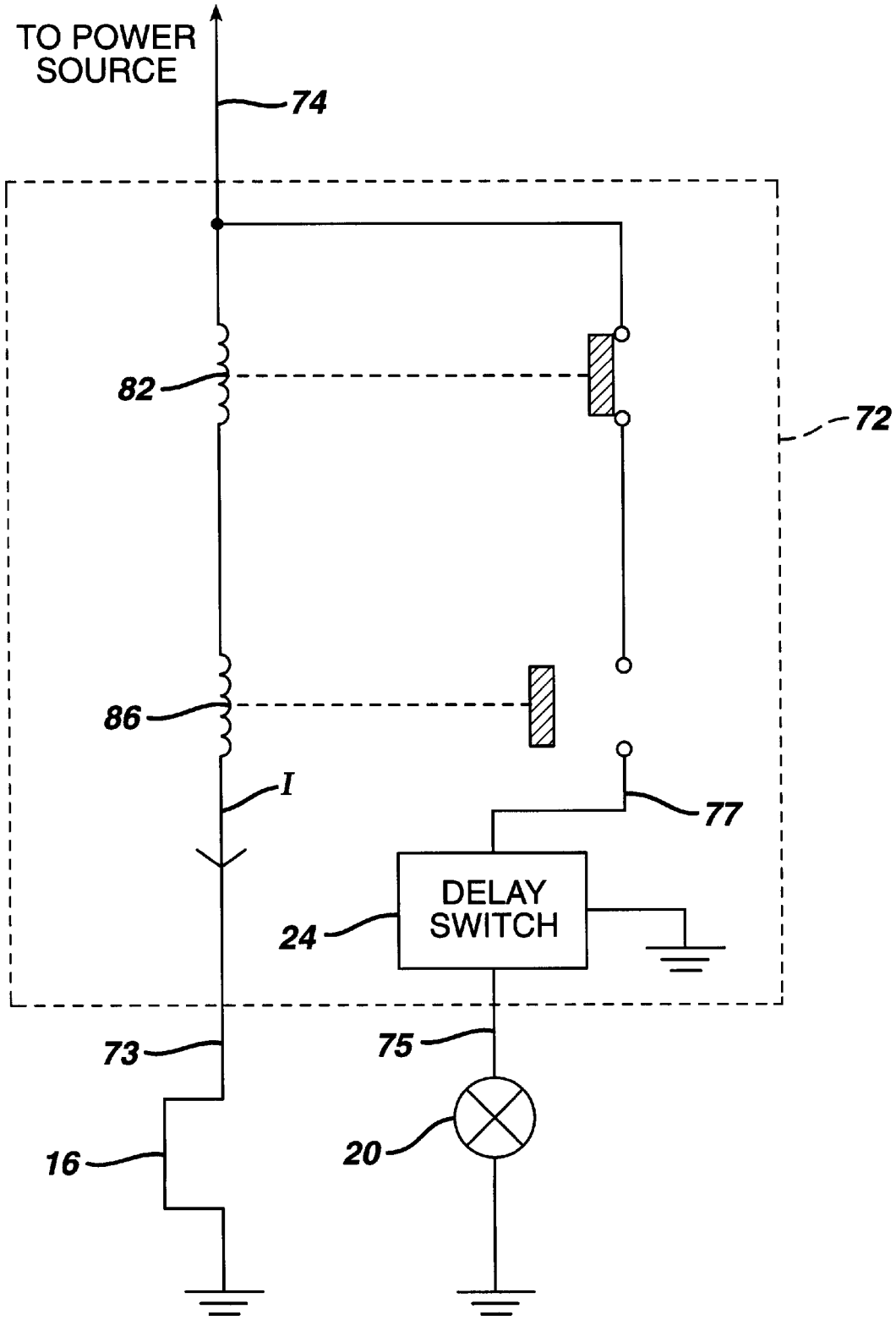
FIG. 9 is a diagram of the ignition controller in FIG. 8.

FIG. 9 shows an exemplary embodiment of the ignition controller 72. Ignition controller 72 is designed such that gas valve 20 is opened only when a suitable ignition temperature is reached. A suitable ignition temperature is realized when the current (I) reaching ignitor 16 is of a predetermined level. In this embodiment, ignition controller 72 comprises relays 82 and 86 that are placed in series on the line 73 which couples the power source 12 to the ignitor 16. Relays 82 and 86 typically comprise current actuated switches such as solenoid relays, which can be purchased from a variety of commercial vendors such as Newark Electronics Corp., of New Jersey. The relays can be adapted to operate with a variety of power sources, as would be apparent to one of skill in the art. Other current sensitive circuit components such as other switches, fuses, and diodes can be utilized in the ignition controller 72 as will be apparent to those of skill in the art.

In the embodiment shown in FIG. 9, relay 82 is normally closed. Relay 82 opens only if the current I through line 73 is greater than an upper current level $I_2$. When relay 82 is open, line 74 is not connected to the gas valve 20.

Relay 86 is a current actuated relay that is normally in the open position, as shown in FIG. 9. When relay 86 is in the open position, line 74 is not connected to the gas valve 20. Relay 86 closes when the current I through line 73 is greater than a threshold current level $I_1$.

Thus, the gas valve 20 is only coupled to the power source 12 when $I_1<I<I_2$. When the current level through the ignitor is too low ($I<I_1$; temperature too low) or the current level is too high ($I>I_2$; temperature too high), the gas valve 20 will be shut off, thus providing a safety feature to the gas appliance. The minimum current limit $I_1$ protects against an open circuit condition which may have been caused by ignitor burnout, for example. The maximum current limit $I_2$ protects against a short across the ignitor or elsewhere, for example.

In operation, the ignition system 70 can provide gas to burner 18 when the current is at a level corresponding to an ignitor temperature of between 800 degrees and 1500 degrees centigrade, for example. Typically, a temperature range of between 1200 and 1400 degrees centigrade is utilized. The actual values for the lower and upper current levels (i.e., $I_1$ and $I_2$) can depend on a number of factors including, but not limited to, the voltage source utilized, the resistance characteristics of the ignitor, and the physical size of the ignitor. Accordingly, the upper and lower current levels can be selected based on these factors, as would be apparent to one of skill in the art given the present description.

According to other embodiments of the invention, the relay 82 can be replaced with a fuse in line 73 which disconnects the ignitor 16 and the gas valve 20 if the current through line 73 exceeds a certain value. Alternatively, the two relays 82 and 86 can be replaced by a three-way (multi-position) solenoid relay which is normally open and closes only when the current in line 73 is between $I_1$ and $I_2$. These features are described in detail in U.S. Ser. No. 09/301,980, entitled "Ignition System for a Gas Appliance", by Levinson et al., filed on the same day as the present application, which is hereby incorporated by reference.

Also shown in FIG. 9 is a delay switch 24 which generally operates as described above with respect to FIG. 2, with the exception that the input line 77 is from the power source 12 as opposed to the ignitor 16. The delay switch 24 operates to delay the opening of the gas valve 20 for a preselected delay period. The delay period begins when the current through the ignitor 16 is between $I_1$ and $I_2$, at which point both relays 82, 86 are closed. Thus, the gas valve 20 is opened only after the current through the ignitor 16 has remained between $I_1$ and $I_2$ for the predetermined delay period. If the current through the ignitor 16 strays below $I_1$ or above $I_2$ before the delay period has elapsed, or at any time thereafter, the delay switch 24 is reset, such that the delay switch must go through another delay period before the gas valve 20 is opened.

Figure 10:
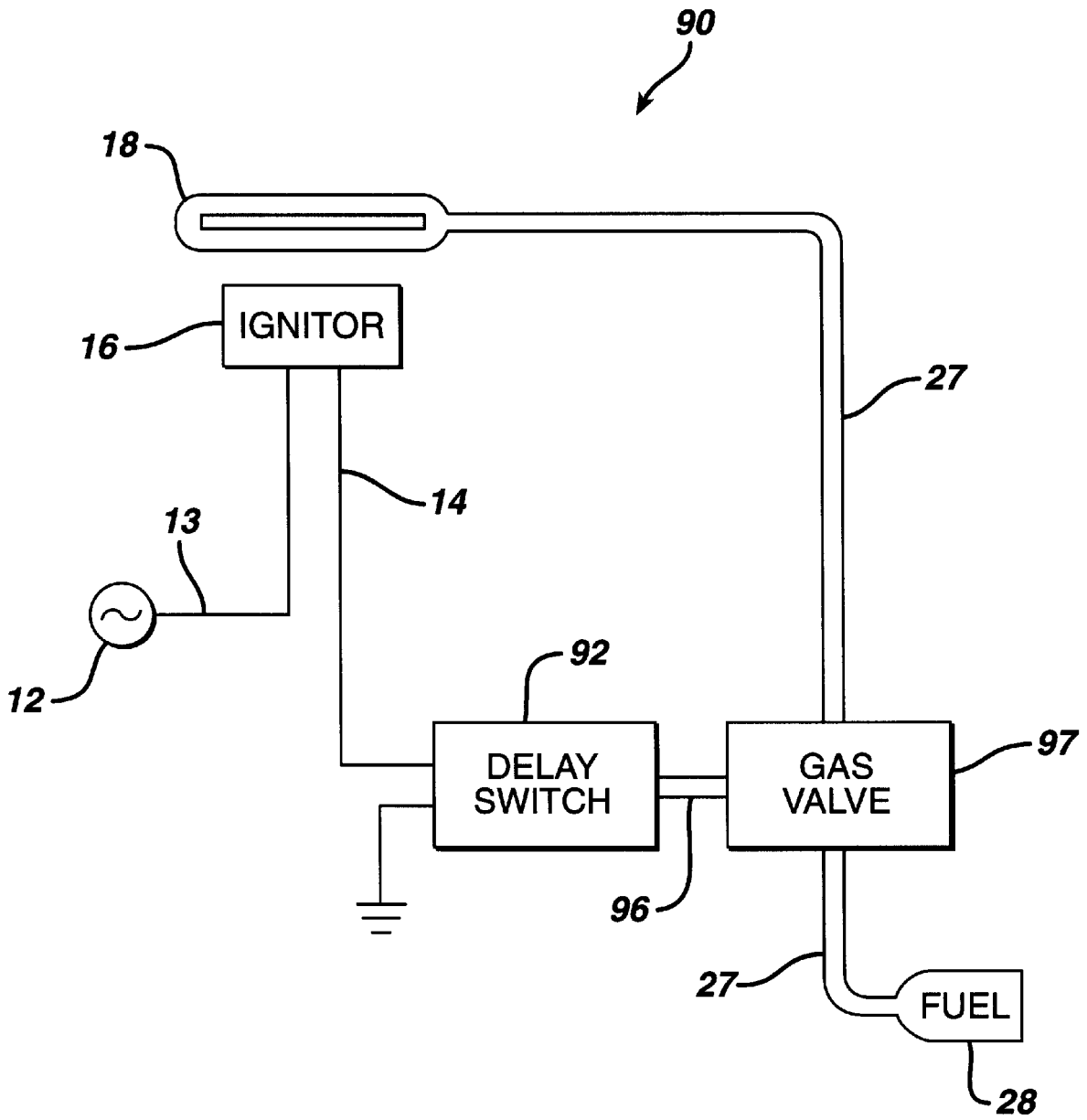
FIG. 10 is a drawing of an ignition system according to another embodiment of the invention.
Figure 11:
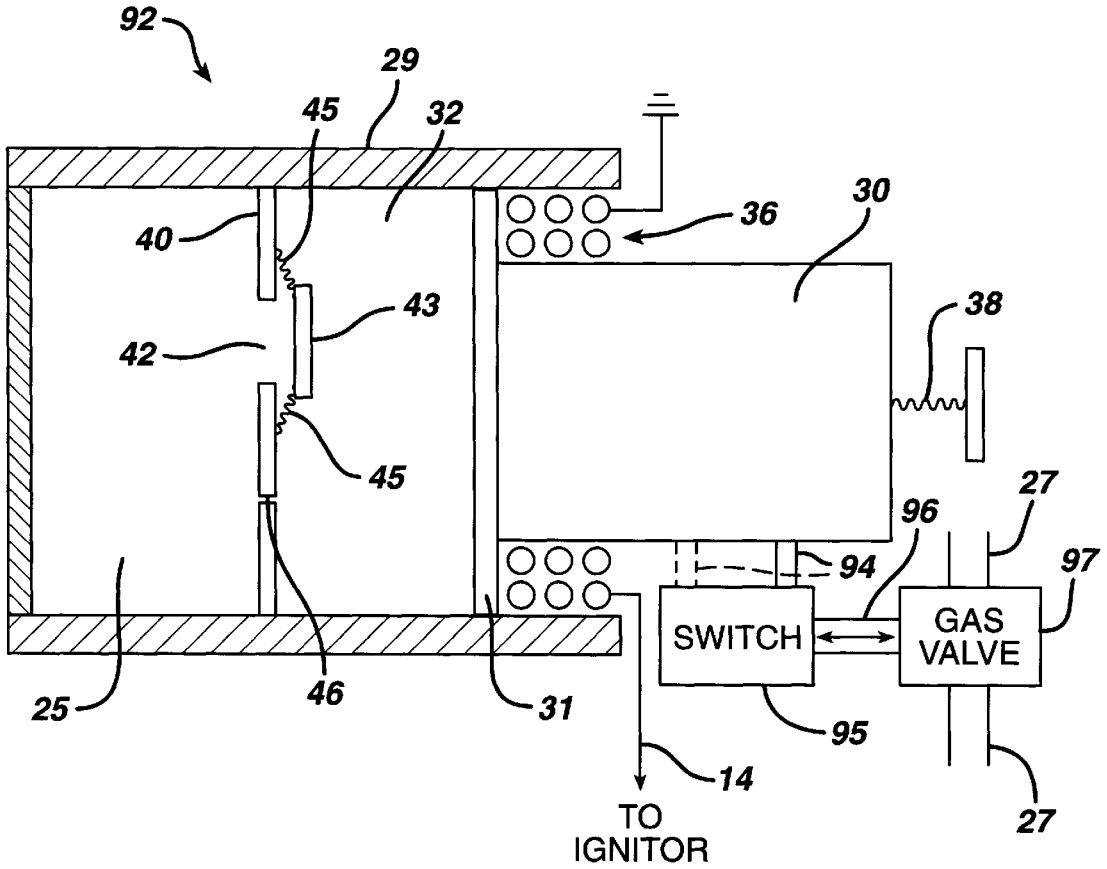
FIG. 11 is a drawing of the delay switch in FIG. 10 which is mechanically coupled to the gas valve.

FIG. 10 illustrates an ignition system according to another embodiment of the invention. The ignition system 90 includes a power source 12, an ignitor 16, a burner 18, and a fuel source 28. In this embodiment, there is provided a delay switch which is mechanically coupled to the gas valve, as shown in detail in FIG. 11. The delay switch 92 comprises a cylinder 29, a piston 30, a plunger 31, a coil 36, a spring 38, a wall 40, a large aperture 42, a small aperture 46, and a sealing member 43, which generally operate as described above with respect to FIG. 2.

The delay switch 92 also includes a mechanical switch 95, and a first coupling member 94, fixed to the piston 30, which couples the piston 30 to the mechanical switch 95. The first coupling member 94 moves with the piston between a first position (solid lines) and a second position (dashed lines). The mechanical switch 95 also includes a second coupling member 96 which mechanically couples the mechanical switch 95 to the gas valve 97. The second coupling member 96 is moved back and forth along its axis in the direction of the arrow to open and close the gas valve 97. The mechanical switch 95 is typically configured to rapidly switch the second coupling member 96 from a closed valve position to an open valve position when the first coupling member 94 reaches the second position (dashed lines). In this way, the gas valve 97 remains closed during the delay period while the piston moves from the first position to the second position. Conventional "snap action" springs can be used to implement the mechanical switch 95, for example.

The present invention is particularly useful in a wide range of gas appliances and heating equipment, including gas ovens, furnaces, boilers, and water heaters.

The foregoing description of exemplary embodiments of the invention has been presented for purposes of illustration and description. It is not intended to be exhaustive or to limit the invention to the precise forms disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A delay switch for a gas appliance, the gas appliance comprising a gas valve, the delay switch comprising:

a first member;

a second member which moves relative to the first member;

an activator which moves the second member relative to the first member from a first relative position to a second relative position in a first time period; and a deactivator which moves the second member relative to the first member from the second relative position to the first position in a second time period less than the first time period;

wherein the second member is coupled to the gas valve such that when the first and second members are in the second relative position, the gas valve is open, and when the first and second members are in the first relative position, the gas valve is closed;

and wherein the activator is coupled to an ignitor such that when the ignitor is first turned on, the activator moves the second member to delay opening the gas valve to prevent any gas from reaching the ignitor during the first time period.

2. The delay switch of claim 1, wherein the second member comprises a piston, and the first and second members define a chamber.

3. The delay switch of claim 1, wherein the activator comprises a magnetic coil which generates a magnetic field to move the second member relative to the first member.

4. The delay switch of claim 3, wherein the deactivator comprises a spring which acts to move the second member from the second relative position to the first relative position.

5. The delay switch of claim 1, wherein the first or the second member comprises a first aperture which affects the rate at which the second member moves relative to the first member.

6. The delay switch of claim 5, further comprising a sealing member which seals the first aperture when the second member moves from the first relative position to the second relative position, and which sealing member moves away from the first aperture when the second member moves from the second relative position to the first relative position.

7. The delay switch of claim 6, further comprising a magnet, coupled to the sealing member, which causes the sealing member to seal the first aperture.

8. The delay switch of claim 5, further comprising a sealing member which seals the first aperture in response to an increase in pressure in a chamber defined by the first and second members.

9. The delay switch of claim 5, wherein the first or the second member further comprises a second aperture, smaller than the first aperture.

10. The delay switch of claim 2, further comprising a plunger extending from the piston, wherein the plunger includes an aperture which affects the rate at which the second member moves relative to the first member.

11. The delay switch of claim 2, wherein the first member further defines a second chamber, and the first aperture allows fluid communication between the chamber and the second chamber.

12. The delay switch of claim 1, wherein the second member is coupled to an electrical switch which is electrically coupled to the gas valve.

13. The delay switch of claim 1, wherein the second member is mechanically coupled to the gas valve.

14. The delay switch of claim 1, wherein the first time period is at least 15 seconds.

15. The delay switch of claim 1, wherein the second time period is at most 1 second.

16. An ignition system for a gas appliance comprising:

an ignitor which ignites gas;

a gas valve which controls the flow of gas to the ignitor; and a delay switch, wherein the delay switch comprises:

a first member;

a second member which moves relative to the first member;

an activator which moves the second member relative to the first member from a first relative position to a second relative position in a first time period; and a deactivator which moves the second member relative to the first member from the second relative position to the first relative position in a second time period less than the first time period;

wherein the second member is coupled to the gas valve such that when the first and second members are in the second relative position, the gas valve is open, and when the first and second members are in the first relative position, the gas valve is closed;

and wherein the activator is coupled to the ignitor such that when the ignitor is first turned on, the activator moves the second member to delay opening the gas valve to prevent any gas from reaching the ignitor during the first time period.

17. The ignition system of claim 16, wherein the second member comprises a piston, and the first and second members define a chamber.

18. The ignition system of claim 17, wherein the chamber includes a wall having a first aperture which closes when the second member moves from the first relative position to the second relative position, and which opens when the second member moves from the second relative position to the first relative position.

19. The ignition system of claim 18, wherein the wall includes a second aperture which is smaller than the first aperture.

20. The ignition system of claim 16, wherein the delay switch further comprises a plunger extending from the second member, and the plunger includes an aperture.

21. The ignition system of claim 20, further comprising a sealing member which seals the aperture.

22. The ignition system of claim 16, wherein the activator and the deactivator comprise at least one of a magnetic coil and a spring.

23. The ignition system of claim 16, wherein the ignitor comprises a material having a resistance characteristic in which resistance increases with temperature.

24. The ignition system of claim 23, wherein the ignitor comprises a silicon carbide based composite material.

25. The ignition system of claim 23, wherein the ignitor comprises an insulating ceramic, a semiconductive ceramic, and a metallic conductor.

26. The ignition system of claim 23, wherein the ignitor comprises at least one of SiC—$MoSi_2$—AlN and SiC—$MoSi_2$—$Al_2O_3$.

27. The ignition system of claim 23, wherein the ignitor comprises a resistive material disposed between two ceramic members.

28. The ignition system of claim 27, wherein the resistive material includes at least one of tungsten, molybdenum, a compound containing tungsten, and a compound containing molybdenum, and the ceramic members comprise silicon nitride.

29. The ignition system of claim 16, wherein the delay switch is connected in series between the ignitor and the gas valve.

30. The ignition system of claim 16, further comprising a first relay, connected in series with the ignitor, which disconnects the gas valve when the current through the ignitor is less than a first predetermined value.

31. The ignition system of claim 30, further comprising a second relay, connected in series with the ignitor, which disconnects the gas valve when the current through the ignitor is greater than a second predetermined value.

32. The ignition system of claim 16, wherein the ignitor is connected in series between the delay switch and a power source.

33. The ignition system of claim 16, wherein the second member is coupled to a switch which is electrically coupled to the gas valve.

34. The ignition system of claim 16, wherein the second member is coupled to a switch which is mechanically coupled to the gas valve.

35. An apparatus comprising:

an ignitor for igniting gas;

a gas valve which controls the flow of gas to the ignitor; and a delay switch which delays the opening of the gas valve, the delay switch comprising:

a piston;

a receiving member, the piston and the receiving member defining a chamber, the volume of the chamber being variable depending on the position of the piston relative to the receiving member; and an activator:

wherein the activator moves the piston from a first position to a second position relative to the receiving member in a predetermined time period;

wherein the chamber includes a first aperture and a second aperture smaller than the first aperture, the first aperture having a sealing member which seals the first aperture when the piston moves from the first position to the second position to resist the motion of the piston;

wherein the piston is coupled to the gas valve such that when the piston reaches the second position, the gas valve is opened;

and wherein the activator is coupled to the ignitor such that when the ignitor is first turned on, the activator moves the piston to delay opening the gas valve to prevent any gas from reaching the ignitor during the predetermined time period.

36. A method of controlling the opening of a gas valve comprising the steps of:

(a) electrically coupling an ignitor to a delay switch, such that the delay switch is activated in response to the ignitor receiving a predetermined current level, wherein activation of the delay switch includes:

driving a second member of the delay switch from a first position to a second position relative to a first member of the delay switch; and providing a resistive force which resists movement of the second member from the first position to the second position; and (b) coupling the second member of the delay switch to the gas valve such that when the ignitor is first turned on, the resistive force delays opening the gas valve to prevent any gas from reaching the ignitor when the second member is being driven from the first position to the second position, and when the second member reaches the second position, the gas valve is opened.

37. The method of claim 36, further comprising the step of removing the resistive force when the second member moves from the second position to the first position.

38. The method of claim 37, wherein the step of providing a resistive force comprises forcing air through a first aperture, and the step of removing the resistive force comprises opening a second aperture larger than the first aperture.

39. The method of claim 36, further comprising the step of driving the second member in a direction from the second position to the first position when the current through the ignitor falls below the predetermined current level.

40. The method of claim 36, wherein the resistive force comprises air resistance.

41. The method of claim 36, wherein the second member of the delay switch is electrically coupled to the gas valve.

42. The method of claim 36, wherein the second member of the delay switch is mechanically coupled to the gas valve.

43. The method of claim 36, wherein the predetermined current level is between a lower current value $I_1$ and an upper current value $I_2$.

44. The method of claim 36, wherein the predetermined current level is any current above a lower current value.

* * * * *